US006312371B1

(12) United States Patent
Long

(10) Patent No.: US 6,312,371 B1
(45) **Date of Patent: *Nov. 6, 2001**

(54) ON-THE-FLY CUT SHEET FOLDER

(75) Inventor: John A. Long, Scarborough (CA)

(73) Assignee: Longford Equipment International Limited, Ontario (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/663,395

(22) Filed: Jun. 13, 1996

(51) Int. Cl.[7] ..... B65H 45/22
(52) U.S. Cl. ..... 493/434; 493/438; 493/441
(58) Field of Search ..... 493/417, 438–440, 493/423, 436, 441, 446, 447, 455

(56) References Cited

U.S. PATENT DOCUMENTS

| | | | | |
|---|---|---|---|---|
| 2,088,805 | | 8/1937 | Olm et al. . | |
| 3,642,270 | * | 2/1972 | Patton, Jr. | 493/423 |
| 4,022,457 | | 5/1977 | Marin et al. . | |
| 4,508,529 | * | 4/1985 | Feldkamper | 493/441 X |
| 4,588,393 | | 5/1986 | Cogswell et al. . | |
| 4,721,504 | * | 1/1988 | Cogswell et al. | 493/438 X |
| 5,037,365 | * | 8/1991 | Breton | 493/438 X |
| 5,383,836 | | 1/1995 | Long . | |

FOREIGN PATENT DOCUMENTS

| | | |
|---|---|---|
| 668412 | 12/1988 | (CH) . |
| 4035106 | 5/1992 | (DE) . |
| 1460487 | 1/1977 | (GB) . |

* cited by examiner

*Primary Examiner*—David A. Scherbel
*Assistant Examiner*—Anthony Ojini
(74) *Attorney, Agent, or Firm*—Rader, Fishman & Grauer PLLC

(57) ABSTRACT

An on-the-fly cut sheet folder has a pinch feeding conveyor for pinch feeding a medial panel of a cut sheet in order to feed the sheet in a downstream direction. A fold up plough extends along one side of the pinch feeding conveyor and a fold down plough extends along the other side of the conveyor. A folded sheet conveyor extends below and downstream of the pinch feeding conveyor. The ploughs extend beyond the downstream end of the pinch feeding conveyor and toward the folded sheet conveyor in order to guide sheets folded by the ploughs onto the downstream conveyor.

12 Claims, 3 Drawing Sheets

ON-THE-FLY CUT SHEET FOLDER

FIELD OF THE INVENTION

This invention relates to an on-the-fly cut sheet folder.

DESCRIPTION OF RELATED ART

U.S. Pat. No. 4,022,457 issued May 10, 1977 to Marin et al. describes an on-the-fly cut sheet folder. The folder comprises a scoring station to form two parallel score lines in a sheet fed therethrough so as to divide the sheet into a medial panel and two peripheral panels. From the scoring station, the sheet passes to a fold initiation station comprising a pinch feeding conveyor having ploughs on either side thereof. The ploughs fold one peripheral panel of the sheet down and the other peripheral panel up such that at the downstream end of the ploughs both peripheral panels make a 90 degree angle with the medial panel. At this stage, the sheet is transferred to a fold completing station comprising a series of progressively smaller pinch rollers for feeding the medial panel of the sheet. A twisted belt overlies these pinch rollers and is directed at a 90 degree angle to the pinch feed rollers at the upstream end of the fold completing station and is parallel to these pinch feed rollers at the downstream end of the fold completing station. A twisted belt also underlies these pinch rollers and is directed at a 90 degree angle to the pinch rollers at the upstream end of the fold completing station and is parallel to these pinch rollers at the downstream end of this station. The progressively smaller feeding pinch rollers terminate upstream of this downstream end of the fold completing station. With this arrangement, a sheet exiting the fold initiation station is taken up by the pinch feed rollers of the fold completing station and continues downstream. As the sheet does so, the upper and lower twisted belts progressively increase the fold of the peripheral panels with respect to the medial panel of the sheet such that at the downstream end of the fold completing station, the letter sheet is Z-folded.

It is expected that it may be difficult to control a sheet between the fold initiation station and the fold completing station so as to avoid paper jams. It any event, a simpler transfer arrangement would be of more economical manufacture.

The subject invention succeeds to overcome drawbacks of known on-the-fly cut sheet folders.

SUMMARY OF THE INVENTION

According to the present invention there is provided an on-the-fly cut sheet folder, comprising: a pinch feeding conveyor for pinch feeding a medial portion of a cut sheet in order to feed said sheet in a downstream direction; a first plough extending along a first side of said pinch feeding conveyor for progressively folding a first peripheral panel of said sheet as said sheet is fed by said pinch feeding conveyor) a second plough extending along a second, opposite, side of said pinch feeding conveyor for progressively folding a second peripheral panel of said sheet as said sheet is fed by said pinch feeding conveyor; a folded sheet conveyor extending below and downstream of said pinch feeding conveyor for conveying sheets exiting from said pinch feeding conveyor; said first plough extending downstream of a downstream end of said pinch feeding conveyor and toward said folded sheet conveyor for assisting in guiding said sheet to said folded sheet conveyor; said second plough extending downstream of said downstream end of said pinch feeding conveyor and toward said folded sheet conveyor for assisting in guiding said sheet to said folded sheet conveyor.

Both the first and second ploughs extend downstream of a downstream end of the pinch feeding conveyor and bend downwardly toward the folded sheet conveyor for assisting in guiding a sheet onto the folded sheet conveyor.

BRIEF DESCRIPTION OF THE DRAWINGS

In the Figures which disclose an example embodiment of this invention.

DETAILED DESCRIPTION OF THE PREFERRED EMBODIMENTS

Figure 1:
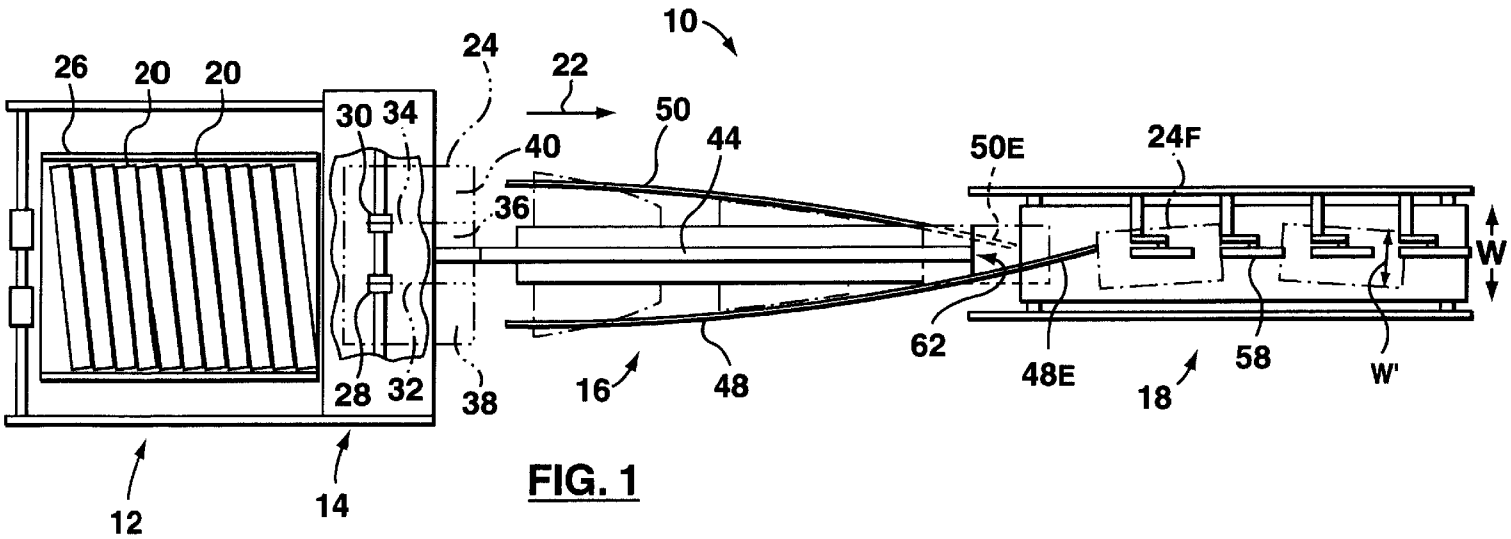
FIG. 1 is a simplified plan view of an on-the-fly cut sheet folder made in accordance with this invention
Figure 2:
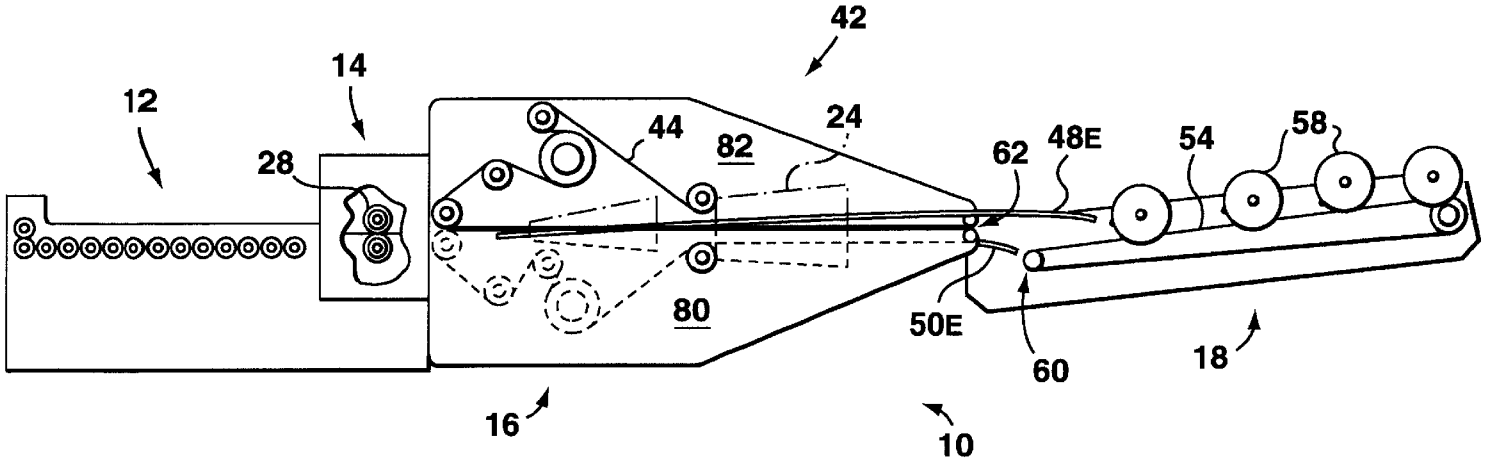
FIG. 2 is a side view of the folder of FIG. 1.

With reference to FIGS. 1 and 2, a folder indicated generally at 10 comprises, in downstream order, an alignment table 12, a scoring station 14, a folding station 16, and a downstream folded sheet conveyor 18.

The alignment table comprises a series of parallel feed rollers 20 which make an acute angle with respect to the downstream feed direction 22 of paper sheets 24 fed by folder 10. As will be appreciated by those skilled in the art, sheets 24 fed along the alignment table 12 will be urged by this table into abutting relation with alignment edge 26 of the table so that all sheets entering the scoring station 14 will be in proper registration with respect to the scoring station. Optionally, an alley race (not shown) may be positioned along alignment edge 26.

The scoring station 14 has a first scorer 28 and a second scorer 30 in order to score a sheet of paper 24 passing therethrough along a first line 32 and a parallel second line 34 thereby dividing the sheet 24 into a medial panel 36 and two peripheral panels 38 and 40. As a sheet 24 exits scoring station 14, the medial panel 36 is taken up by pinch feeding conveyor 44. A first plough 48 extends along the first side of the pinch feeding conveyor 44 in order to progressively fold the first peripheral panel 38 of the sheet 24 upwardly as the sheet is fed by the pinch feeding conveyor 44. A second plough 50 extends along a second, opposite, side of the pinch feeding conveyor 44 for progressively folding a second peripheral panel 40 of the sheet downwardly as the sheet is fed by the pinch feeding conveyor.

The folded sheet conveyor 18 extends below the level of, and downstream of, the pinch feeding conveyor 44. The downstream conveyor comprises an inclined conveyor belt 54 having an upstream end 60 with a width W which is greater than the width W' of folded letter sheets 24F on conveyor 18. A plurality of feed wheels 58 rest on the folded sheet conveyor 18 downstream of the upstream end 60 of this conveyor for maintaining folded letter sheets 24F in their folded condition.

The first plough 48 has an extension 48E which extends downstream of the downstream end 62 of the pinch feeding conveyor 44 and toward conveyor 18 for assisting in guiding a folded letter sheet 24F to the conveyor 18. Similarly, the second plough 50 has an extension 50E which extends downstream of the downstream end 62 of the pinch feeding conveyor 44 and toward the folded sheet conveyor 18, also for assisting in guiding a folded sheet 24F to the folded sheet conveyor. In this connection, it will be noted from FIG. 2 that extension 48E dips downwardly toward conveyor 18 as does extension 50E. Further, as seen in FIG. 1, both plough extensions are inclined toward each other. Extension 50E of plough 50 terminates adjacent the upstream end 60 of conveyor 18.

Figure 3:
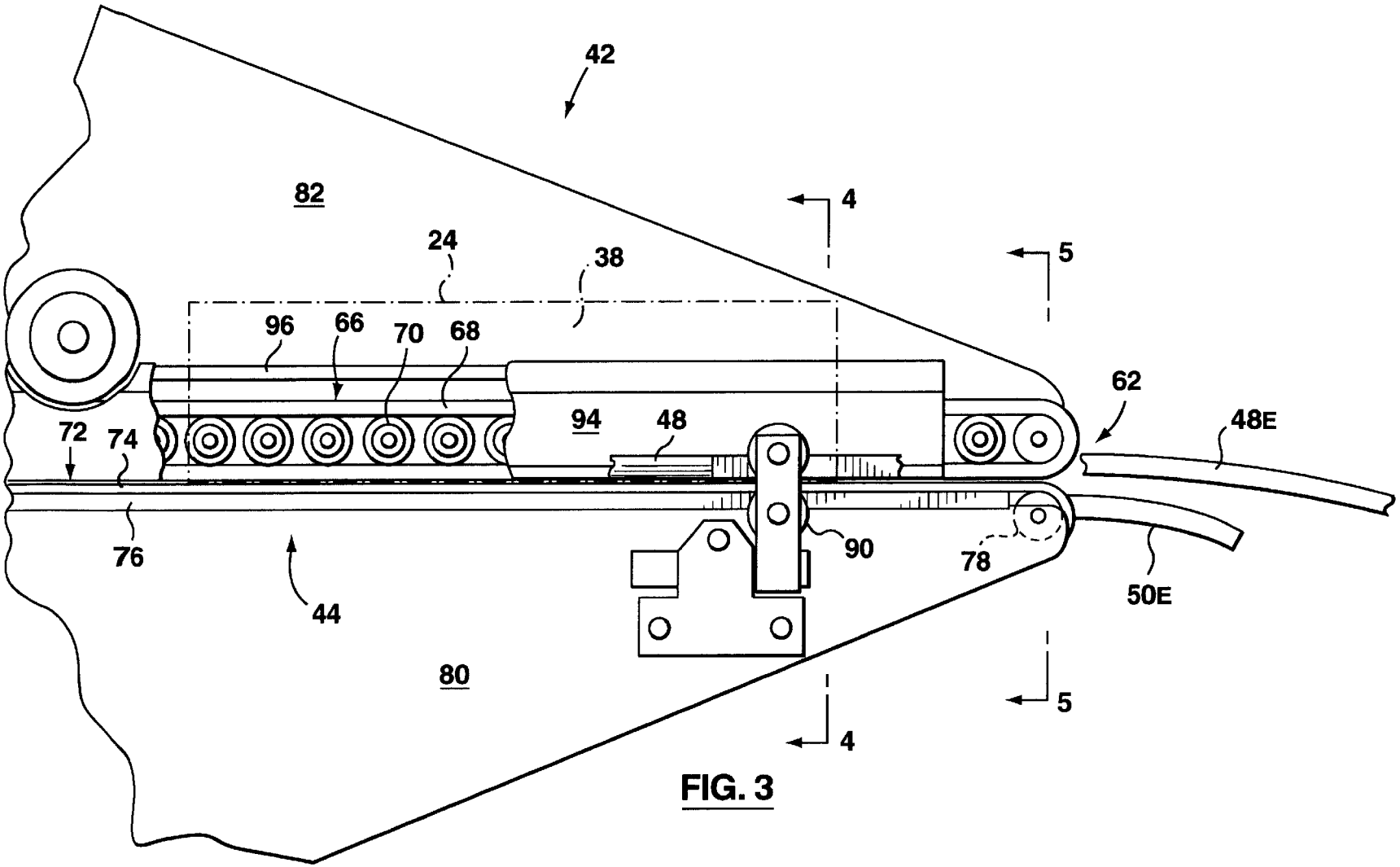
FIG. 3 is fragmentary side view detail of a portion of the folder of FIG. 1.
Figure 5:
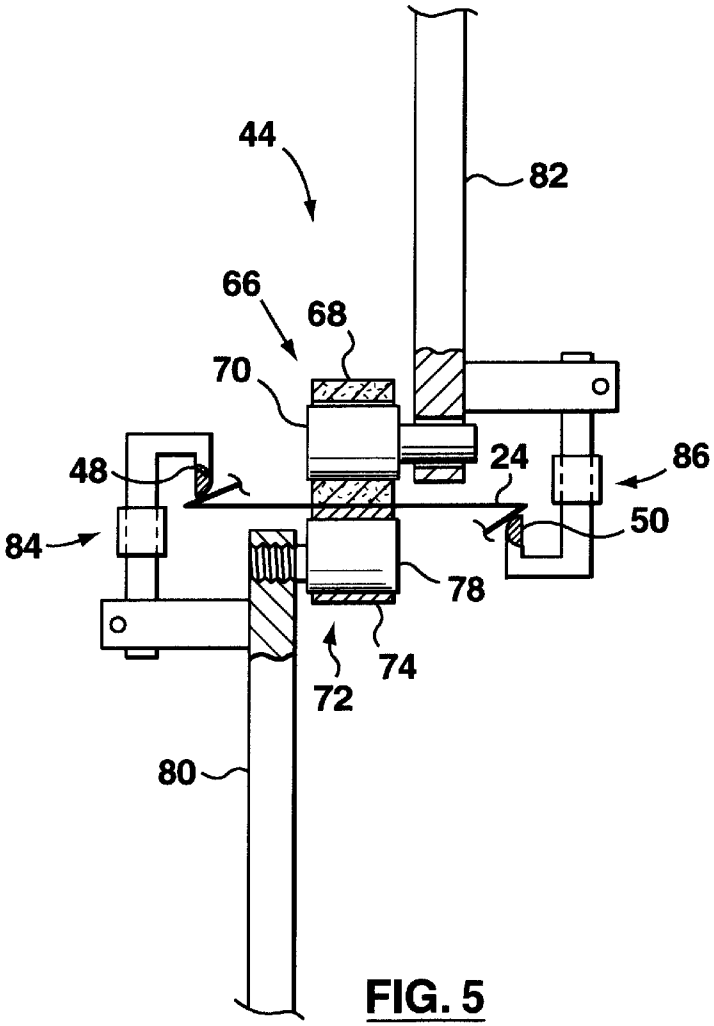
Figure 4:
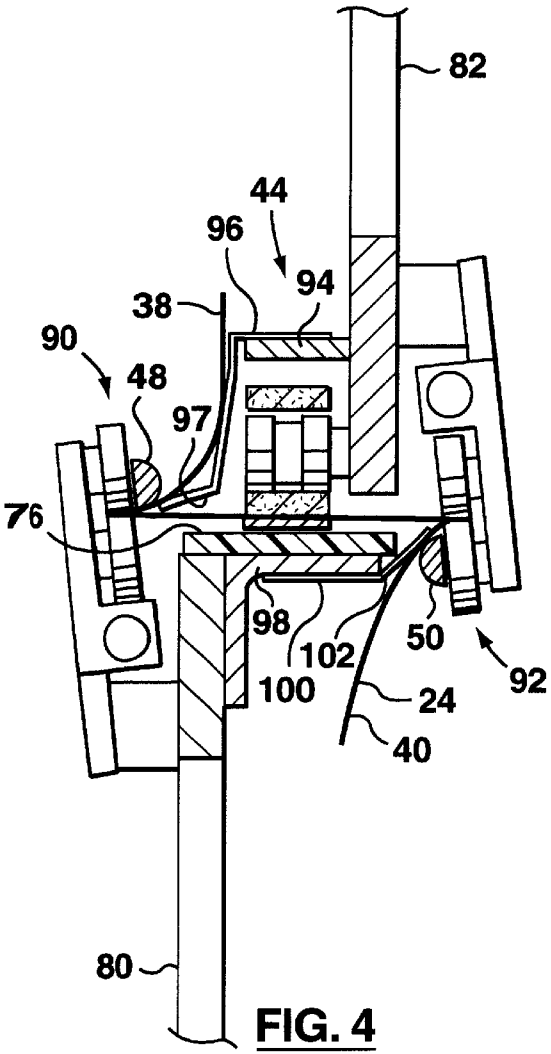
FIG. 4 is a cross-sectional view along the lines 4—4 of FIG. 3 and, FIG. 5 is a cross-sectional view along the lines 5—5 of FIG. 3.

Further details of folding station 16 will be apparent by reference to FIGS. 3 through 5. Turning to FIG. 3, it will be seen that the pinch feeding conveyor 44 has an upper conveyor 66 comprising a resilient dense foam conveyor belt riding on guide rollers 70. Pinch feeding conveyor 44 also has a lower conveyor 72 comprising a conveyor belt 74 riding atop a hard platform 76 which terminates at a guide wheel 78 for the lower conveyor belt 74.

Referencing FIG. 5 along with FIG. 3, a first frame member 80 at the first side of the pinch feeding conveyor 44 supports guide wheel 78 and, therefore, lower conveyor 72. First frame number 80 also supports first plough 48 by way of adjustable plough support 84. It will be noted that the first frame member 80 extends downwardly from the lower conveyor 72. A second frame member 82 at the second side of the pinch feeding conveyor 44 supports the upper conveyor 66 by reason of supporting each of the guide rollers 70 of this conveyor. Frame member 82 also supports an adjustable plough support 86 for plough 50. It will be noted that the second frame member extends upwardly from the upper conveyor 66. (For clarity, the adjustable plough supports have been omitted from FIG. 3).

Referencing FIG. 4 along with FIG. 3, a first pair of pinch rollers 90 is supported by the first frame member 80 at the first side of the pinch feeding conveyor 44 proximate the downstream end 62 of the pinch feeding conveyor. A second pair of pinch rollers 92 is supported by the second frame member 82 at the second side of the pinch feeding conveyor 44 in line with the first pair of pinch rollers 90. The second frame member 82 has a lateral extension 94 on which is mounted a cowling 96 terminating in a flange 97. Frame 80 has a lateral extension 98 on which is mounted lower conveyor platform 76 and a cowling 100 terminating in flange 102.

As will be apparent from FIGS. 3 and 4, plough 48 changes from having a circular cross-section upstream of the pinch rollers 90 to having a half-circular cross-section downstream of these pinch rollers 90. This is to allow the pinch rollers to be closely positioned with respect to the plough. Plough 50 is similarly designed.

In operation, a sheet of paper 24 fed to alignment table 12 is moved by the alignment table 12 into abutment with alignment edge 26 as it feeds downstream on the table. When the sheet 24 enters scoring station 14, the sheet is scored at lines 32 and 34 thereby dividing the sheet into a medial panel 36 and first and second peripheral panels 38 and 40, respectively. As the sheet exits the scoring station 14, it is taken up by pinch feeding conveyor 44. More particularly, the medial panel 36 of the sheet is pinched between the upper resilient conveyor belt 68 and the lower conveyor belt 74 of the pinch feeding conveyor 44 and fed downstream by these belts. From FIG. 1 it is apparent that when the sheet moves past the upstream end of the first and second ploughs 48, 50, the first peripheral panel 38 of the sheet will be in overlying relation with respect to the first plough 48 and the second peripheral panel 40 will be in underlying relation with respect to the second plough 50. As the sheet continues to feed downstream, plough 48 progressively folds up the first peripheral panel 38 and plough 50 progressively folds down the second peripheral panel 40. When sheet 24 approaches the pairs of pinch rollers 90, 92, the peripheral panels 38, 40 have been folded past ninety degrees with respect to the medial panel 36. Consequently, these peripheral panels extend toward the pinch feeding conveyor 44. At this stage, cowling 96 prevents peripheral panel 38 from contacting the pinch feeding conveyor 44 and cowling 100 prevents peripheral panel 40 from contacting the pinch feeding conveyor 44. When the ploughs 48, 50 have sufficiently folded over the peripheral panels 38, 40 of sheet 24, the sheet is sandwiched between flange 97 of cowling 96 and plough 48 at the first side of the pinch feeding conveyor 44 and between flange 102 of cowling 100 and plough 50 at the second side of the pinch feeding conveyor 44. Thus, the flange 97 acts as a backing plate for plough 48 and flange 12 acts as a backing plate for plough 50. The sheet is therefore quite constrained at this stage of its progression through the folder 42 so that the folded edges of the sheet are predictable placed. This placement is in line with pinch roller 90,92 so that these folded edges pass through the pinch rollers 90, 92 and are creased in order to iron the fold between the medial panel and each peripheral panel 38, 40 of the sheet 24.

It will be noted that by providing the first frame member 80 at the first side of the pinch feeding conveyor and having the second frame member 82 extend upwardly from the pinch feeding conveyor 44, the second peripheral panel 40 is free to fold farther than it would have been allowed to do should the second frame member 82 have extended below the pinch feeding conveyor 44. Similarly, with frame member 82 extending along the second side of the pinch feeding conveyor 44 and the first frame member 80 extending downwardly from the pinch feeding conveyor, panel 38 is free to fold further than it would have been allowed to do should first frame member 80 have extended above the pinch feeding conveyor 44. Thus, this arrangement permits more complete folding of the sheet 24 in the folding station 16.

As a sheet exits from the downstream end 62 of the pinch feeding conveyor 44, it has two creased and ironed folds and has a loose Z-fold configuration. Extension 48E of plough 48 extends beyond downstream end 62 and overlies panel 38. Extension 50E of plough 50 extends beyond downstream end 62 and underlies panel 40. Both plough extensions 48E, 50E extend toward folded sheet conveyor 18 so as to ensure the sheet 24F falls on top of this conveyor 18. More particularly, the downward dip of each extension assists in directing the sheets to the conveyor 18 and the inward incline of each extension results in each sheet being more fully supported than it would be if the extensions paralleled the downstream direction 22 of the folder 10. Because the plough extensions 48E and 50E constrain the letter sheet 24 only loosely, the letter sheet may land on downstream conveyor 18 somewhat skewed as illustrated in FIG. 1. Nevertheless, these extensions ensure the letter sheet does land on folded sheet conveyor 18 in a reasonably controlled fashion such that the letter sheets will pass under the feed wheels 58 resting on conveyor 18 so that the sheets will be maintained in a folded condition as they move along this conveyor. Downstream of conveyor 18, a registration device may be provided to realign the folded letter sheets 24F.

By providing resilience in the pinch feeding conveyor 44, the folder 10 may be employed with sheets of a variety of thicknesses. Alternatively, sheets with credit cards or other inserts affixed to the medial panel may also be feed through the folder 10.

While the upper conveyor has been described as a resilient conveyor belt riding on wheels, this could be replaced with a plurality of resilient wheels. Alternatively, the upper conveyor could be a standard generally non-resilient belt riding on floating feed wheels with a spring pressure bar overlying the upper conveyor to provide a constant spring pressure urging this upper conveyor into pinching relationship with the lower conveyor. Of course, the upper conveyor could be non-resilient and the lower conveyor made resilient.

Although ploughs 48 and 50 with their extensions 48E, 50E have been shown as integral bars, the ploughs could have other configurations and their extensions could be separate parts.

While folder 10 is arranged for Z-folding of letter sheets, it will be appreciated that it may easily be modified to form a traditional letter folds in a sheet (i.e., each peripheral panel is folded up and over the medial panel of the sheet). Other modifications will be apparent to those skilled in the art and, therefore, the invention is defined in the claims.

What is claimed is:

1. An on-the-fly cut sheet Z-folder, comprising:

a pinch feeding conveyor for pinch feeding a medial portion of a cut sheet in order to feed said sheet in a downstream direction;

a first plough extending along a first side of said pinch feeding conveyor, positioned to extend under a first panel of said sheet, and configured to progressively fold said first peripheral panel of said sheet upwardly as said sheet is fed by said pinch feeding conveyor;

a second plough extending along a second, opposite, side of said pinch feeding conveyor, positioned to extend over a second panel of said sheet, and configured to progressively fold said second peripheral panel of said sheet downwardly as said sheet is fed by said pinch feeding conveyor;

a folded sheet conveyor having an upstream end extending below a path of a sheet exiting said pinch feeding conveyor and downstream of said pinch feeding conveyor for conveying sheets exiting from said pinch feeding conveyor;

said first plough extending downstream of a downstream end of said pinch feeding conveyor and bending downwardly toward said folded sheet conveyor for assisting in guiding said sheet downwardly onto said folded sheet conveyor;

said second plough extending downstream of said downstream end of said pinch feeding conveyor and bending downwardly toward said folded sheet conveyor for assisting in guiding said sheet downwardly onto said folded sheet conveyor.

2. The folder of claim 1 wherein said pinch feeding conveyor comprises an upper conveyor and a lower conveyor and including a first frame member at said first side of said pinch feeding conveyor supporting said lower conveyor and said first plough and a second frame member at said second side or said pinch feeding conveyor supporting said upper conveyor and said second plough.

3. The folder of claim 2 wherein said first frame member extends downwardly from said lower conveyor and said second frame member extends upwardly from said upper conveyor.

4. The folder of claim 1 including a first pair of pinch rollers at said first side of said pinch feeding conveyor proximate said downstream end of said pinch feeding conveyor for pinching said sheet at a fold made by said first plough between said first peripheral panel and a medial panel of said sheet in order to crease said fold and including a second pair of pinch rollers at said second side of said pinch feeding conveyor proximate said downstream end of said pinch feeding conveyor for pinching said sheet at a fold made by said second plough between said second peripheral panel of said sheet and said medial panel of said sheet in order to crease said fold.

5. The folder of claim 4 including a scoring station upstream of said first plough and said second plough having a first scorer for scoring said sheet between said medial panel and said first peripheral panel and a second scorer for scoring said sheet between said medial panel and said second peripheral panel.

6. The folder of claim 1 wherein one of said upper conveyor and said lower conveyor is resilient whereby said pinch feeding conveyor may feed thick sheets or sheets with inserts attached thereto.

7. The folder of claim 1 wherein said folded sheet conveyor has a width greater than the width between said first scorer and said second scorer whereby said folded sheet conveyor can accommodate folded sheets which land on said folded sheet conveyor skewed.

8. The folder of claim 7 including a feed wheel resting on said folded sheet conveyor downstream of an upstream end of said folded sheet conveyor for maintaining sheets on said folded sheet conveyor in a folded condition.

9. The folder of claim 1 wherein a portion of said first plough extending downstream of a downstream end of said pinch feeding conveyor and toward said folded sheet conveyor is inclined toward a portion of said second plough extending downstream of said downstream end of said pinch feeding conveyor and toward said folded sheet conveyor.

10. The folder of claim 9 wherein said second plough extending portion is inclined toward said first plough extending portion.

11. The folder of claim 1 wherein said first plough extends further downstream of said downstream end of said pinch feeding conveyor than said second plough.

12. The folder of claim 11 wherein said upstream end of said folded sheet conveyor defines a folded sheet feeding path below a sheet conveying path at an exit of said pinch conveyor such that a sheet exiting said pinch feeding conveyor drops onto said folded sheet conveyor.

* * * * *

UNITED STATES PATENT AND TRADEMARK OFFICE

CERTIFICATE OF CORRECTION

PATENT NO. : 6,312,371 B1
DATED : November 6, 2001
INVENTOR(S) : John A. Long

It is certified that error appears in the above-identified patent and that said Letters Patent is hereby corrected as shown below:

Column 6,
Line 2, replace "second side or" with -- second side of --.
Line 53, after "an exit of said pinch" insert -- feeding --.

Signed and Sealed this

Sixteenth Day of July, 2002

*Attest:*

*Attesting Officer*

JAMES E. ROGAN
*Director of the United States Patent and Trademark Office*